US005492060A

United States Patent [19]

Haaf et al.

[11] Patent Number: 5,492,060

[45] Date of Patent: Feb. 20, 1996

[54] PRINTING-PLATE CASSETTE FOR A MAGAZINE

[75] Inventors: Franz Haaf, Dielheim; Thomas Künzl, Eppelheim, both of Germany

[73] Assignee: Heidelberger Druckmaschinen AG, Heidelberg, Germany

[21] Appl. No.: 289,694

[22] Filed: Aug. 12, 1994

[30] Foreign Application Priority Data

Aug. 12, 1993 [DE] Germany ..... 43 27 013.1

[51] Int. Cl.[6] ..... B41F 21/00

[52] U.S. Cl. ..... 101/477; 101/415.1; 271/104

[58] Field of Search ..... 101/415.1, 477, 101/DIG. 36, 485, 486, 480, 389.1; 271/104, 167

[56] References Cited

U.S. PATENT DOCUMENTS 4,502,677 3/1985 Senga et al. ..... 271/104

5,299,498 4/1994 Spiegel et al. ..... 101/477

FOREIGN PATENT DOCUMENTS 4130359 3/1993 Germany .

4129022 6/1993 Germany .

*Primary Examiner*—Christopher A. Bennett

*Attorney, Agent, or Firm*—Herbert L. Lerner; Laurence A. Greenberg

[57] ABSTRACT

Cassette for a magazine for automatically changing printing plates, the cassette being formed for receiving therein a plurality of printing plates with respective spacer elements disposed therebetween, and the printing plates being removable sequentially from the cassette, includes a device located in a marginal region of the cassette for swivellably mounting the spacer elements so that the spacer elements are swivellable out of operative range of the respective printing plates when the printing plates are being removed from the cassette.

11 Claims, 3 Drawing Sheets

PRINTING-PLATE CASSETTE FOR A MAGAZINE

The invention relates to a cassette for a magazine for automatically changing printing plates, the cassette being formed for receiving therein a plurality of printing plates with respective spacer elements disposed therebetween, the printing plates being removable sequentially from the cassette.

Cassettes of this general type have become known heretofore. They serve, respectively, for receiving a plurality of printing plates, so that once the cassette is introduced into the magazine for automatically changing printing plates, these printing plates can be used one after the other. In other words, by means of the cassette insertable into the magazine, a plurality of printing plates are made ready simultaneously and can be transported together to a printing press. The respective introduction of printing plates into and the removal thereof from the cassette is uncomplicated and can be performed without damage. When a printing plate is being removed by the automatically operating plate removal device, it is of great importance that reliable separation of adjacent printing plates be assured, so as to prevent more than one printing plate from being removed simultaneously, and to restrict the removal always to only one at a time.

The problem of multiple removals occurs especially with very thin printing plates (0.24 mm in thickness, for example), when they are new and rest very flatly upon one another in the cassette. Adhesive forces between the plates are very great then. It has also been known heretofore to dispose spacer elements between the individual printing plates in order to counteract the simultaneous removal of a multiple number of plates. The positioning of these spacer elements is relatively difficult, however, because of the tight space available and requires considerable skill and a smooth touch.

It is accordingly an object of the invention to provide a printing-plate cassette for a magazine for automatically changing printing plates from which a simultaneous removal of more than one printing plate is prevented and, moreover, wherein the cassette according to the invention is readily manipulatable.

With the foregoing and other objects in view, there is provided, in accordance with the invention, a cassette for a magazine for automatically changing printing plates, the cassette being formed for receiving therein a plurality of printing plates with respective spacer elements disposed therebetween, the printing plates being removable sequentially from the cassette, comprising means located in a marginal region of the cassette for swivellably mounting the spacer elements so that the spacer elements are swivellable out of operative range of the respective printing plates when the printing plates are being removed from the cassette.

In accordance with another feature of the invention, the marginal region is a side region of the cassette.

In accordance with a further feature of the invention, the cassette includes at least another marginal region of the cassette opposing the first-mentioned marginal region, the means being located in each of the marginal regions and comprising a respective swivel shaft common to respective pluralities of the spacer elements.

In accordance with an added feature of the invention, the spacer elements are formed as fan blades.

In accordance with an additional feature of the invention, the blades are embodied as strips.

In accordance with yet another feature of the invention, the strips are formed of plastic material.

In accordance with yet a further feature of the invention, the means located in the marginal region comprise a swivel shaft located at end regions of the blades opposite to a direction in which the printing plates are removable from the cassette.

In accordance with yet an added feature of the invention, the cassette includes a wall formed with a recess, the swivel elements being swivellable about the swivel shaft out of the recess and back into a position within the recess.

In accordance with still another feature of the invention, the wall is a guide rail of the cassette.

In accordance with still a further feature of the invention, the cassette includes stop means for limiting swivelling movement of the blades back into the recess formed in the guide rail of the cassette.

In accordance with still an added feature of the invention, the stop means comprise a marginal rib formed on the cassette.

In accordance with a concomitant feature of the invention, the marginal rib is formed with a break-through through which the fan blades are manually manipulatable. Thus, the spacer elements are swivel or pivot elements supported in the side regions of the cassette and leave the operative range of the printing plates upon the removal or withdrawal of the printing plates. The spacer elements according to the invention are thus fixedly mounted, yet pivotable or swivellable, at a predetermined location of the cassette. When a cassette is newly equipped with printing plates, the spacer elements are swiveled between the individual printing plates and, as a result, when one printing plate is removed or withdrawn, the spacer elements prevent the adjacent printing plate from being taken or entrained therewith. The removal or withdrawal movement pivots or swivels the appertaining spacer elements so that they move out of operative range of the printing plates and thus cannot be a hindrance, for example, by causing jamming the next time a printing plate is removed or withdrawn. Because the spacer elements can pivot or swivel yet due to the swivel or pivot axis thereof being held stationary within the pivot or swivel range, assurance is provided that they will always be located in the desired region, and this region is selected so that reliable separation of the printing plates from one another is effected. These spacer elements according to the invention are preferably located next to the entrainment elements (such as suction devices, for example,) of the plate withdrawal or removal device. If a cassette is emptied and, if it is to be equipped with new printing plates, the same spacer elements are then used because, by simply swiveling them outwardly, they return to the operative position at the printing plates to be inserted.

In accordance with the invention, at least one common pivot or swivel shaft is provided for a plurality of pivot or swivel elements in each marginal or peripheral region, such as side regions particularly, of the cassette. The swivel or pivot elements may preferably be the blades of a fan or, in other words, the spacer device is formed of pivotable or swivellable spacer elements arranged in fan-like fashion. Preferably, the blades have a strip-like form; in particular, they are constructed as strips of plastic material.

It is advantageous if the pivot or swivel shaft is located on the end regions of the blades opposite the removal or withdrawal device. Assurance is thereby provided that the spacer elements which are arranged in a fan-like fashion will swivel back when printing plates are removed or withdrawn from the cassette.

The pivot or swivel elements, in the swiveled or pivoted-back position, enter a recess formed in a wall, in particular a guide rail, of the cassette. If they are pivoted or swiveled back from the outwardly pivoted or swiveled position thereof to the position thereof between the printing plates, they then enter the aforementioned recess and, as a result, do not hinder the removal or withdrawal of further printing plates. Introducing the printing plates into the magazine is also especially simple, because one printing plate is always initially placed therein without having the spacer pivot or swivel elements get in the way, and outward pivoting or swiveling into the operative range of the printing plates does not take place until the printing plate is in place. As a result of the outward pivoting or swiveling, the spacer elements then protrude from both sides of the cassette. Then, the next printing plate is put in place, portions thereof resting on the spacer elements. The appertaining spacer elements are then pivoted or swiveled outwardly, and a further printing plate is then inserted, and so forth.

Upon automatic plate removal or withdrawal by means of the conventional plate removal device, the bent-away trailing edge of the printing plate preferably meets the appertaining pivot or swivel elements in the removal or withdrawal movement, so that these elements pivot or swivel back into the respective recess.

To limit the back-pivoting or swiveling movement, a suitable stop is assigned to the recess. This stop is preferably formed respectively by a guide rail of the cassette. To facilitate a manual manipulation of the fan-like arrangement of the pivot or swivel elements, for example, when a cassette is being equipped with printing plates, an access opening or break-through is formed in each guide rail.

Other features which are considered as characteristic for the invention are set forth in the appended claims.

Although the invention is illustrated and described herein as embodied in a printing-plate cassette for a magazine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
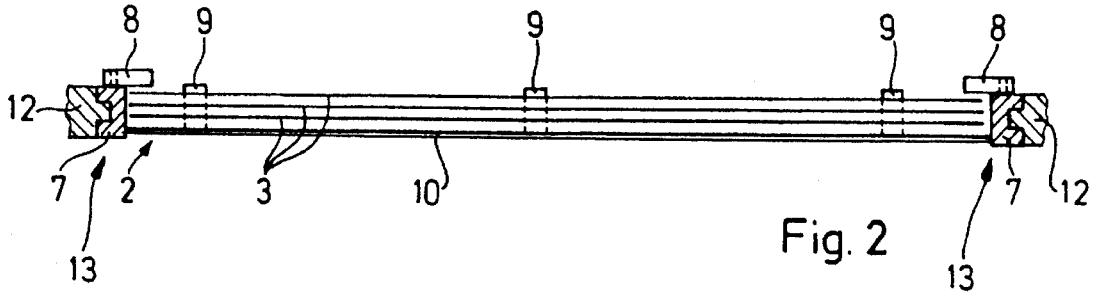
FIG. 2 is a fragmentary end view of the magazine with the cassette received in guides of the magazine.
Figure 1:
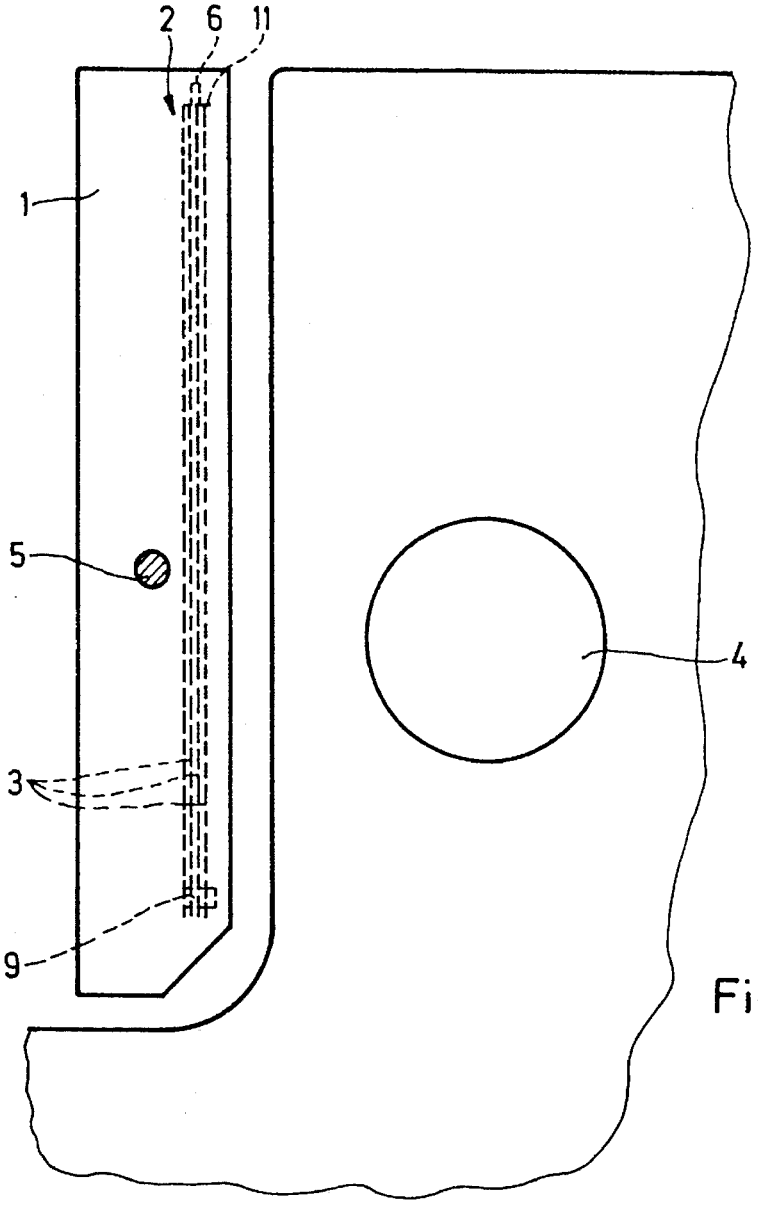
FIG. 1 is a fragmentary diagrammatic side elevational view of a printing press with a magazine equipped with a cassette.

Referring now to the drawings and, first, particularly to FIG. 1 thereof, there is shown therein a magazine 1 supported on a printing unit of a printing press. A cassette 2 containing a plurality of printing plates 3 is insertable into the magazine 1 from above. To enable a printing plate to be automatically supplied to the plate cylinder 4 of the printing unit, the magazine 1 is raised vertically and swiveled about a pivot shaft 5 so that the printing plates 3 are deliverable one at a time by means of a non-illustrated conventional plate removal device to the plate cylinder 4 for suitable deployment, i.e., clamping and locking thereon. The removal initially requires lifting the uppermost printing plate 3 out of indexing bolts 9. It is apparent from FIG. 2 that there are three indexing bolts 9 in the cassette 2, which extend through openings in the printing plates 3. Once the uppermost printing plate 2 has been lifted out of the indexing bolts 9, it is pulled out of the cassette 2 and delivered to the plate cylinder 4. For the purpose of removing the printing plate 3, the aforementioned non-illustrated plate removal device is provided with suction devices which are activatable for "grasping" the printing plate 3.

For manipulating the cassette 2, a handle 6 is provided in the vicinity of an edge 11 thereof located at an upper part of FIG. 1. The cassette 2 equipped with printing plates 3 can thus be carried by the handle 6 thereof to the printing press and inserted into the magazine 1. The magazine 1 has guides 12 into which U-shaped guide rails 7, which form side regions 13 of the cassette 2, are insertable. In this manner, the cassette 2 is held in the magazine 1. The guide rails 7 are secured to a bottom 10 of the cassette 2, as viewed in FIG. 2. Also disposed on the guide rails 7 are swivellable retainers 8, which can be swiveled in front of the printing plates 3 for securing purposes, for example, when the cassette 2 which has not yet been inserted into the magazine 1 is being transported.

Figure 3:
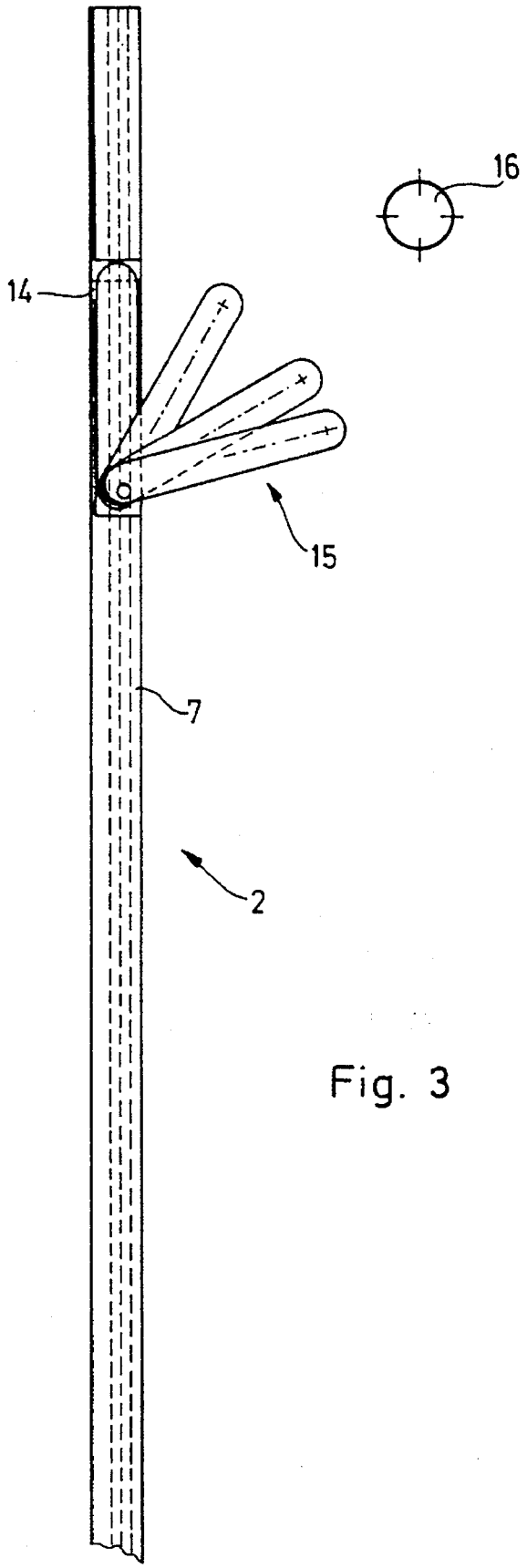
FIG. 3 is a cutaway side region of a cassette.

As shown in FIG. 3, a recess 14 is formed in each guide rail 7 of the cassette 2, and spacer elements 15 are swivellably mounted in each recess 14. The spacer elements 15 are located in the immediate vicinity of a suction device 16, which belongs to the otherwise non-illustrated plate removal device.

Figure 4:
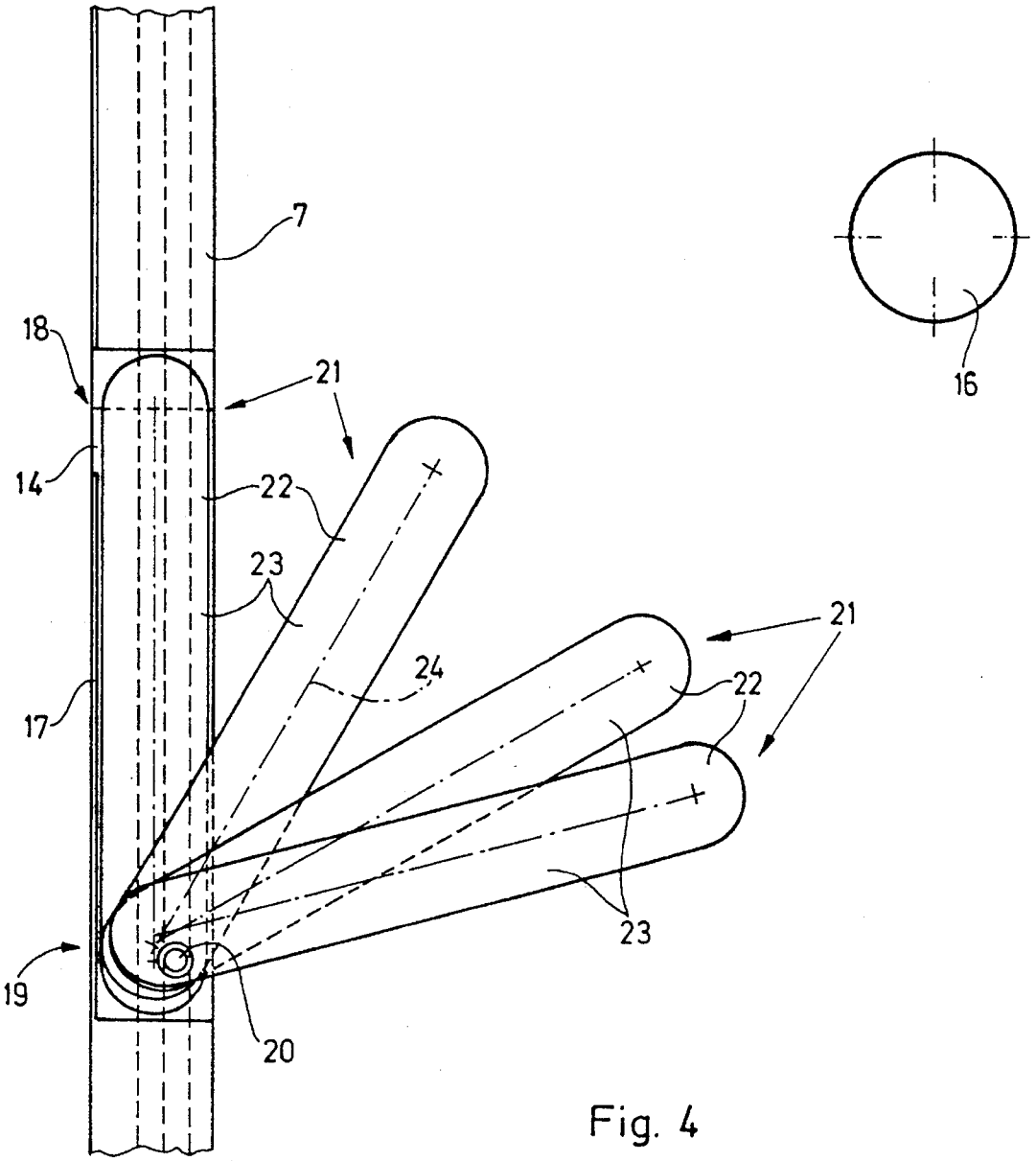
FIG. 4 is an enlarged fragmentary view of FIG. 3.

For an explanation of specific details of construction and operation of the cassette according to the invention, reference may be had to FIG. 4 which is a fragmentary enlarged view of FIG. 3. FIG. 4 clearly shows that the recess 14 is formed in each guide rail 7, preferably by milling, so that it is open towards the printing plates 3 and is closed with a marginal rib 17 on the opposite side. The marginal rib 17 does not extend over the entire length of the recess 14, thereby leaving an opening 18.

A swivel shaft 20 is located in an end region 19 of the recess 14 opposite the direction in which the printing plates 3 are removed from the cassette 2, and a plurality of spacer elements 21, preferably four in number, are swivellably mounted thereon. The spacer elements 21 thus form swivel elements 22. They are constructed as sheets or blades 23, in particular of striplike shape and preferably as strips of plastic material and, due to the swivellable mounting thereof on the swivel shaft 20 in the manner of the blades of a fan, are swivellable into the operative range of the printing plates 3 and returnable to a swiveled-back position wherein they are at rest in the recess 14. The two end regions of each of the blades 23 formed of plastic material are rounded. Preferably, the swivel shaft 20 located in the lower end region of the blades 23, as viewed in FIG. 4, for example, is offset with respect to the center line 24 of each pivot element 22 in a direction towards the printing plates 3 or, in other words, is disposed eccentrically relative to the respective spacer element 21.

In FIG. 4, the various pivot elements 22 are shown in different swivel positions thereof.

When an empty cassette 2 is to be equipped with printing plates 3, a first printing plate 3 is initially inserted, and then the appertaining spacer elements 21 are swiveled out of the corresponding recesses 14 into the two side regions 13. The opening 18 is helpful for this manipulation. The next printing plate 3 is then inserted, and the further swivel elements 22 are swiveled outwardly, and so forth. The thus equipped cassette 2 is then carried to the printing press and inserted into the guides 12 by means of the handle 6. Should a printing plate 3 be deployed, i.e., clamped and locked, onto the plate cylinder 4, the magazine 1 is then brought into the swivel position thereof, and the uppermost printing plate 3 is engaged by the suction device 16 of the otherwise non-illustrated plate removal device and lifted out of the indexing bolts 9 and then withdrawn. The conventionally bent-away trailing edge of the corresponding printing plate 2 ensures that, during the withdrawal movement, the appertaining swivel elements 22 will swivel back into the recesses 14. If a further printing plate 3 is subsequently needed, the same aforedescribed process is performed accordingly. Each time a printing plate is removed, the swivellably mounted spacer elements 21 always assure that only a single printing plate is removed, and that thus a reliable separation of the various printing plates 3 is effected. The marginal rib 17 limits the back-swivelling movement of the individual spacer elements 21.

We claim:

1. A cassette assembly for a magazine for automatically changing printing plates, comprising: a cassette having mutually opposite marginal regions and being formed for receiving therein a plurality of printing plates, a plurality of printing plates removably disposed in said cassette and respective spacer elements disposed therebetween, said printing plates being removable sequentially from said cassette, mounting means located in each of the marginal regions of said cassette for swivellably mounting said spacer elements, said mounting means comprising a respective swivel shaft common to respective pluralities of said spacer elements.

2. Cassette according to claim 1, wherein said marginal region is a side region of the cassette.

3. Cassette according to claim 1, wherein said spacer elements are formed as fan blades.

4. Cassette according to claim 3, wherein said blades are embodied as strips.

5. Cassette according to claim 4, wherein said strips are formed of plastic material.

6. Cassette according to claim 3, wherein said means located in said marginal region comprise a swivel shaft located at end regions of said blades opposite to a direction in which the printing plates are removable from the cassette.

7. A cassette assembly for a magazine for automatically changing printing plates, comprising:

a cassette having mutually opposite marginal regions and being formed for receiving therein a plurality of printing plates, a plurality of printing plates removably disposed in said cassette and respective spacer elements in the form of fan blades disposed therebetween, said printing plates being removable sequentially from said cassette, a swivel shaft located at end regions of said fan blades opposite to a direction in which the printing plates are removable from said cassette, said swivel shaft swivellably mounting said spacer elements, and said cassette including a wall formed with a recess, said swivel elements being swivellable about said swivel shaft out of said recess and back into a position within said recess.

8. Cassette according to claim 7, wherein said wall is a guide rail of the cassette.

9. Cassette according to claim 8, including stop means for limiting swivelling movement of said blades back into said recess formed in said guide rail of the cassette.

10. Cassette according to claim 9, wherein said stop means comprise a marginal rib formed on the cassette.

11. Cassette according to claim 10, wherein said marginal rib is formed with a break-through through which said fan blades are manually manipulatable.

* * * * *